US012180969B2

(12) United States Patent
Yagi et al.

(10) Patent No.: US 12,180,969 B2
(45) Date of Patent: Dec. 31, 2024

(54) CENTRIFUGAL COMPRESSOR

(71) Applicant: MITSUBISHI HEAVY INDUSTRIES COMPRESSOR CORPORATION, Tokyo (JP)

(72) Inventors: Nobuyori Yagi, Tokyo (JP); Akihiko Umeda, Tokyo (JP); Eiichi Yanagisawa, Tokyo (JP); Masayuki Soneda, Hiroshima (JP); Seiji Ohama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 18/355,042

(22) Filed: Jul. 19, 2023

(65) Prior Publication Data

US 2024/0035479 A1 Feb. 1, 2024

(30) Foreign Application Priority Data

Jul. 29, 2022 (JP) ..... 2022-121956

(51) Int. Cl.
*F04D 17/10* (2006.01)
*F04D 29/053* (2006.01)

(52) U.S. Cl.
CPC ..... *F04D 17/10* (2013.01); *F04D 29/053* (2013.01)

(58) Field of Classification Search
CPC .. F04D 25/163; F04D 29/041; F04D 29/0416; F04D 29/0513; F04D 29/052; F04D 29/053
See application file for complete search history.

(56) References Cited

U.S. PATENT DOCUMENTS 8,827,634 B2 * 9/2014 Omori ..... F04D 17/12 415/122.1
9,651,091 B2 * 5/2017 Beers ..... F02C 7/06
2014/0363285 A1 12/2014 Becker
2015/0226233 A1 8/2015 Yagi et al.
2019/0178257 A1 6/2019 Iizuka et al.
(Continued)

FOREIGN PATENT DOCUMENTS

JP S63-094318 U 6/1988
JP H09-269044 A 10/1997
JP 2009-197772 A 9/2009
(Continued)

*Primary Examiner* — Courtney D Heinle
*Assistant Examiner* — Danielle M. Christensen
(74) *Attorney, Agent, or Firm* — Osha Bergman Watanabe & Burton LLP

(57) ABSTRACT

A centrifugal compressor includes: a drive shaft; a wheel gear; a driven shaft; a pinion gear disposed to be rotatable together with the driven shaft, and meshing with the wheel gear; an impeller rotating together with the driven shaft; a thrust collar restricting a displacement of the driven shaft in an axial direction by colliding with the wheel gear in the axial direction; and a plurality of bolts disposed at intervals in a circumferential direction and each extending in the axial direction to fix the thrust collar and the pinion gear. Each of the plurality of bolts fix the thrust collar and the pinion gear in a state where each of the plurality of bolts are inserted from a position opposite to the wheel gear with reference to the thrust collar in the axial direction.

11 Claims, 9 Drawing Sheets

(56) References Cited

U.S. PATENT DOCUMENTS

2019/0353543 A1* 11/2019 Bygrave ..... F04D 29/051

FOREIGN PATENT DOCUMENTS

| | | | |
|---|---|---|---|
| JP | 2014-088803 | A | 5/2014 |
| JP | 6111273 | B2 | 4/2017 |
| JP | 2017-172418 | A | 9/2017 |
| JP | 6680360 | B2 | 4/2020 |

* cited by examiner

CENTRIFUGAL COMPRESSOR

BACKGROUND OF THE INVENTION

Field of the Invention

The present disclosure relates to a centrifugal compressor.

Priority is claimed on Japanese Patent Application No. 2022-121956, filed on Jul. 29, 2022, the content of which is incorporated herein by reference.

Description of Related Art

As one type of centrifugal compressor, there is one called a geared compressor. For example, as disclosed in Patent Document 1, the geared compressor mainly includes a drive shaft and a driven shaft disposed parallel to each other; an impeller provided on the driven shaft; a pinion gear provided on the driven shaft; and a wheel gear provided on the drive shaft and meshing with the pinion gear. In such a geared compressor, a configuration including a thrust bearing that restricts a displacement of the drive shaft and the driven shaft in an axial direction (thrust direction) is disclosed.

[Patent Document 1] Japanese Unexamined Utility Model Application, First Publication No. S63-94318

SUMMARY OF THE INVENTION

By the way, in the configuration disclosed in Patent Document 1, generally, a thrust collar of the thrust bearing is fitted to the driven shaft by shrink fitting or the like. However, when a fluid is compressed by the impeller, a thrust force in the axial direction acts on the impeller and the driven shaft due to a reaction force from the compressed fluid. When the driven shaft is displaced in the axial direction by this thrust force and the thrust collar collides with the wheel gear, the thrust collar receives a reaction force from the wheel gear. As a result, there is a possibility that a shrink-fitted portion of the thrust collar to the driven shaft is lifted. On the other hand, in order to suppress the lifting, increasing a contact area of the shrink-fitted portion of the thrust collar to the driven shaft is considered. However, in order to increase the contact area, the thrust collar or the driven shaft should be lengthened. As a result, there is a high possibility that axial vibration occurs in the driven shaft. For this reason, it is necessary to suppress a misalignment of the thrust collar, which has received a reaction force from the wheel gear, with respect to the driven shaft in the axial direction while fixing the thrust collar to the driven shaft without using shrink fitting.

The present disclosure provides a centrifugal compressor capable of suppressing a misalignment of a thrust collar, which has received a reaction force from a wheel gear, with respect to a driven shaft in an axial direction while fixing the thrust collar to the driven shaft without using shrink fitting.

In order to solve the foregoing problems, according to the present disclosure, there is provided a centrifugal compressor including: a drive shaft extending along a first central axis and rotatable around the first central axis; a wheel gear rotating around the first central axis, together with the drive shaft; a driven shaft disposed parallel to the drive shaft, extending in an axial direction in which the first central axis extends, and rotatable around a second central axis; a pinion gear disposed to be rotatable around the second central axis, together with the driven shaft, and meshing with the wheel gear; an impeller that is disposed at a different position in the axial direction with respect to the pinion gear, and that compresses a working fluid by rotating around the second central axis, together with the driven shaft; a thrust collar disposed adjacent to the pinion gear in the axial direction, and restricting a displacement of the driven shaft in the axial direction by colliding with the wheel gear in the axial direction on an outer side in a radial direction around the second central axis with respect to the driven shaft; and a plurality of bolts disposed at intervals in a circumferential direction around the second central axis and each extending in the axial direction to fix the thrust collar and the pinion gear. Each of the plurality of bolts fixes the thrust collar and the pinion gear in a state where each of the plurality of bolts is inserted from a position opposite to the wheel gear with reference to the thrust collar in the axial direction.

According to the centrifugal compressor of the present disclosure, it is possible to suppress a misalignment of the thrust collar, which has received a reaction force form the wheel gear, with respect to the driven shaft in the axial direction while fixing the thrust collar to the driven shaft without using shrink fitting.

DETAILED DESCRIPTION OF THE INVENTION

Hereinafter, modes for implementing a centrifugal compressor according to the present disclosure will be described with reference to the accompanying drawings. However, the present disclosure is not limited to only the embodiments.

First Embodiment (Configuration of Centrifugal Compressor)

Figure 1:
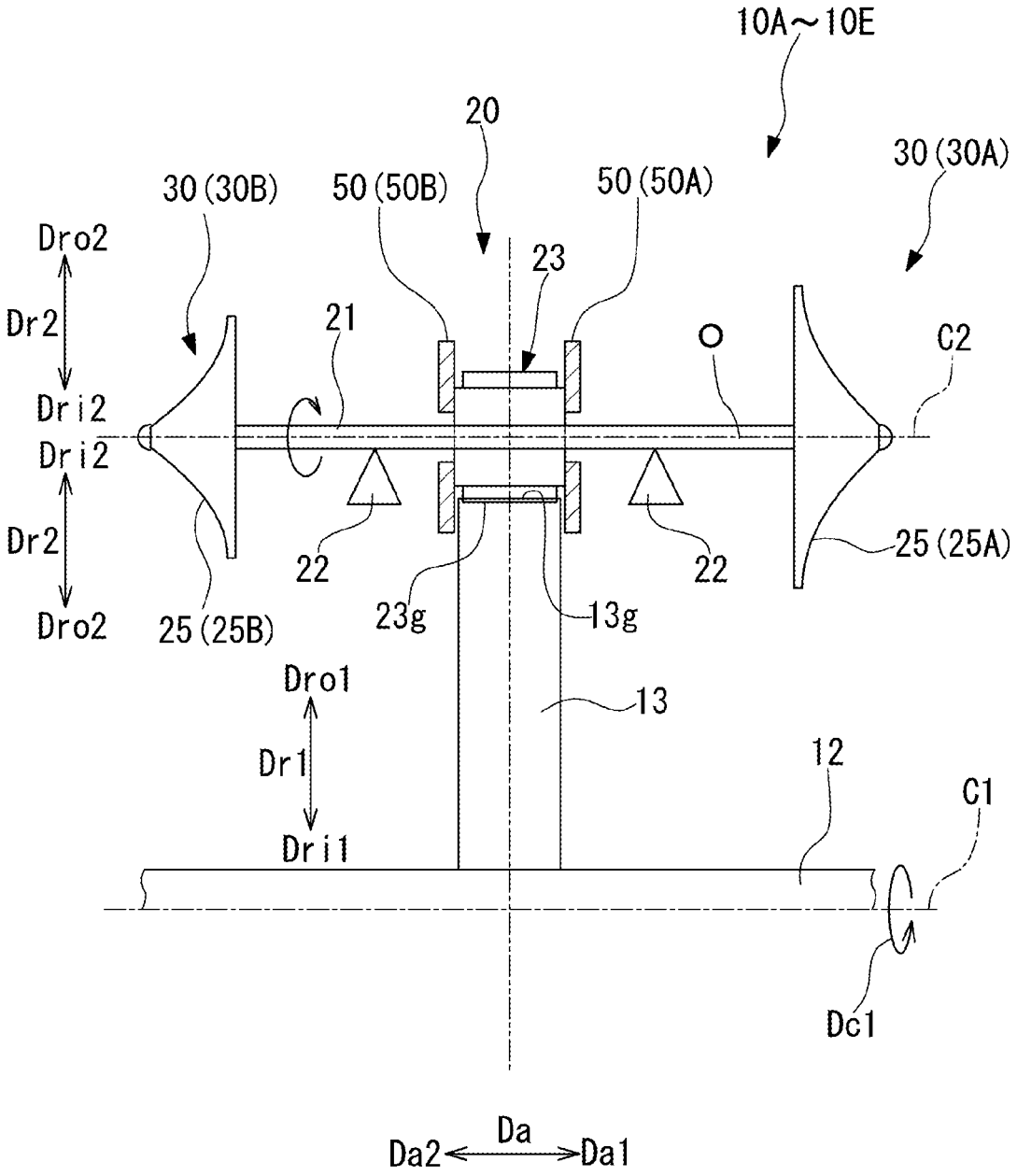
FIG. 1 is a view showing a schematic configuration of a centrifugal compressor according to embodiments of the present disclosure.
Figure 2:
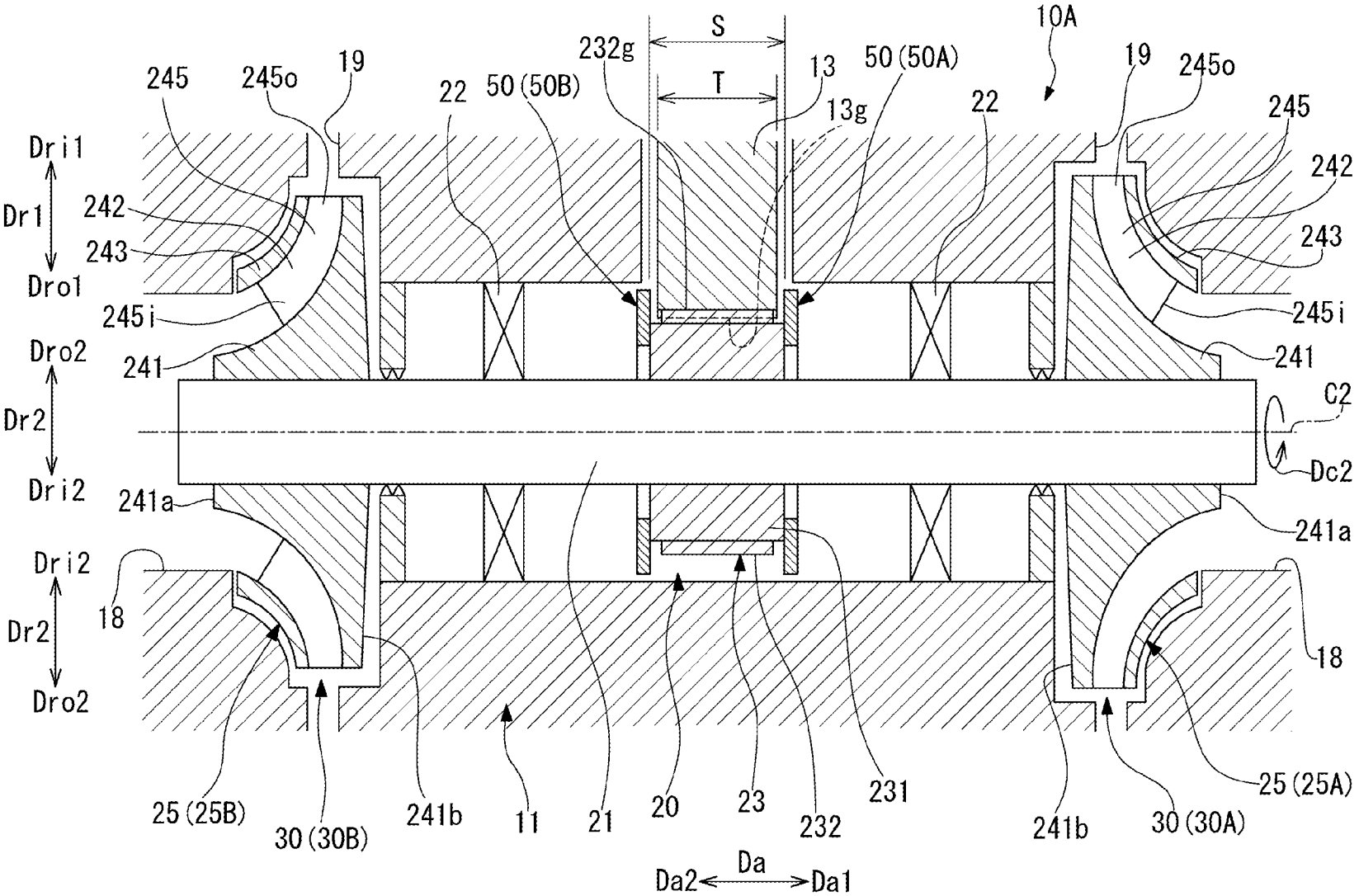
FIG. 2 is a cross-sectional view showing a driven shaft, a pinion gear, a thrust collar, and an impeller of the centrifugal compressor according to a first embodiment of the present disclosure.

As shown in FIGS. 1 and 2, a centrifugal compressor 10A according to the present embodiment mainly includes a casing 11 (refer to FIG. 2), a drive shaft 12, a wheel gear 13, a driven shaft 21, a radial bearing 22, a pinion gear 23, an impeller 25, a thrust collar 50, and a plurality of bolts 70.

As shown in FIG. 2, the casing 11 forms an outer shell of the centrifugal compressor 10A. The casing 11 covers the drive shaft 12, the wheel gear 13, the driven shaft 21, the pinion gear 23, the impeller 25, and the thrust collar 50.

(Configuration of Drive Shaft and Wheel Gear)

As shown in FIG. 1, the drive shaft 12 is formed in a columnar shape extending in an axial direction Da along a first central axis C1. The axial direction Da is an extending direction of the first central axis C1. The drive shaft 12 is supported by bearings (not shown) so as to be rotatable around the first central axis C1. The drive shaft 12 is driven and rotated around the first central axis C1 by a drive source such as a motor provided outside.

Figure 3:
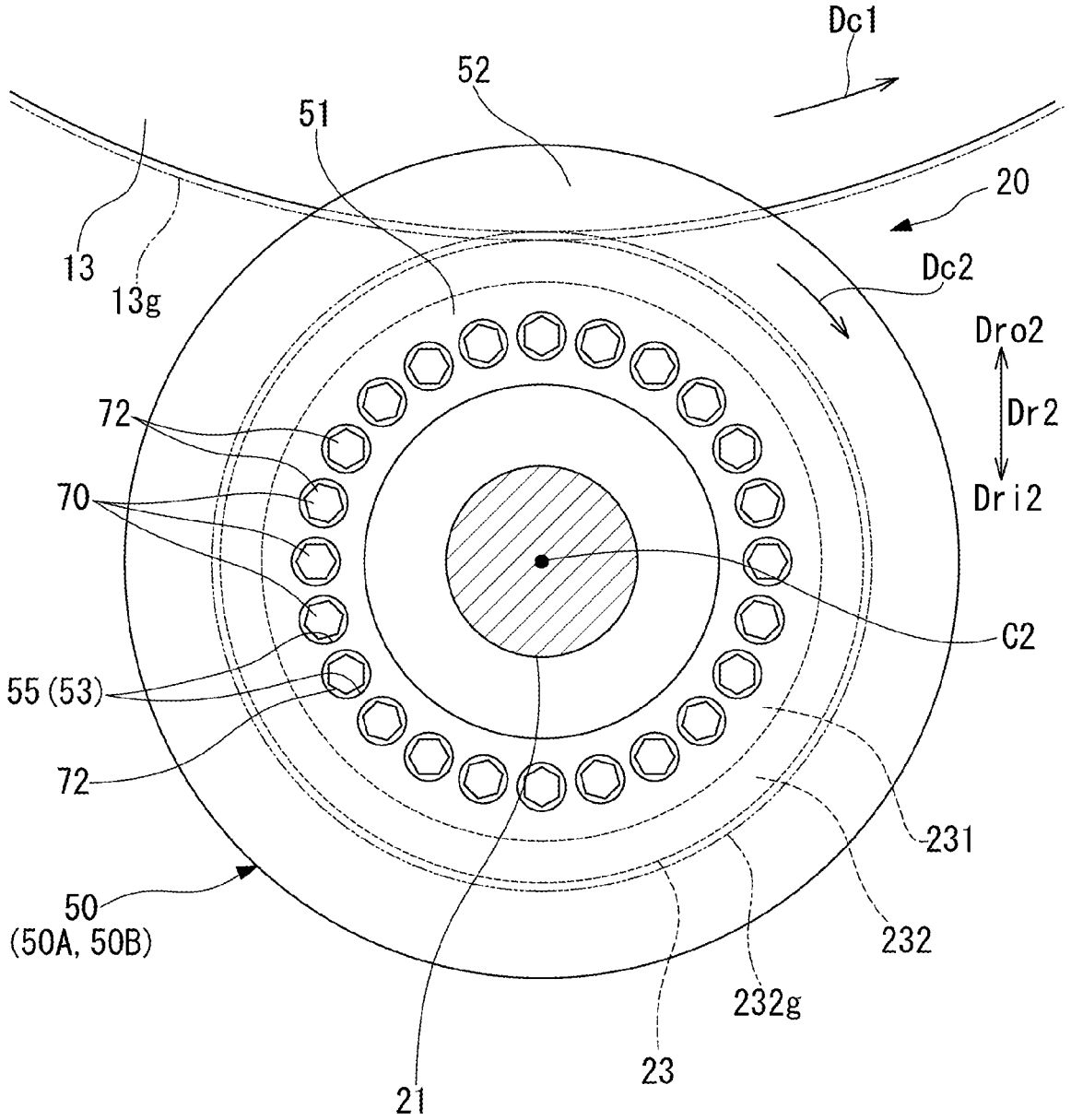
FIG. 3 is a cross-sectional view of a meshing portion between the pinion gear and a wheel gear shown in FIG. 2 when viewed in an axial direction.

The wheel gear 13 is formed integrally with the drive shaft 12. The wheel gear 13 is disposed on an outer side Dro1 in a first radial direction Dr1 around the first central axis C1 with respect to the drive shaft 12. The wheel gear 13 extends in a first circumferential direction Dc1 around the first central axis C1. Namely, the wheel gear 13 is formed in an annular shape around the first central axis C1. As shown in FIGS. 2 and 3, a plurality of wheel gear teeth 13*g* disposed at intervals in the first circumferential direction Dc1 are formed on an outer peripheral portion of the wheel gear 13. The wheel gear 13 rotates around the first central axis C1, together with the drive shaft 12, at the same time as the drive shaft 12 rotates.

(Configuration of Driven Shaft and Pinion Gear)

As shown in FIG. 1, the driven shaft 21 is disposed parallel to the drive shaft 12. The driven shaft 21 is formed in a columnar shape extending in the axial direction Da. The driven shaft 21 is disposed on the outer side Dro1 in the first radial direction DO with respect to the wheel gear 13. The driven shaft 21 is supported by a pair of the radial bearings 22 so as to be rotatable around a second central axis C2. The pair of radial bearings 22 are disposed at an interval in the axial direction Da inside the casing 11. Each of the radial bearings 22 is held on the casing 11.

As shown in FIGS. 2 and 3, the pinion gear 23 is formed integrally with the driven shaft 21. The pinion gear 23 rotates around the second central axis C2, together with the driven shaft 21, at the same time as the driven shaft 21 rotates. The pinion gear 23 is disposed at an intermediate position in the axial direction Da with respect to the driven shaft 21. The pinion gear 23 is disposed between the pair of radial bearings 22 in the axial direction Da. The pinion gear 23 is formed with a smaller outer diameter dimension than that of the wheel gear 13. The pinion gear 23 meshes with the wheel gear 13. Therefore, the rotation speed of the pinion gear 23 and the driven shaft 21 that rotate with the rotation of the wheel gear 13 is larger than the rotation speed of the wheel gear 13.

Figure 4:
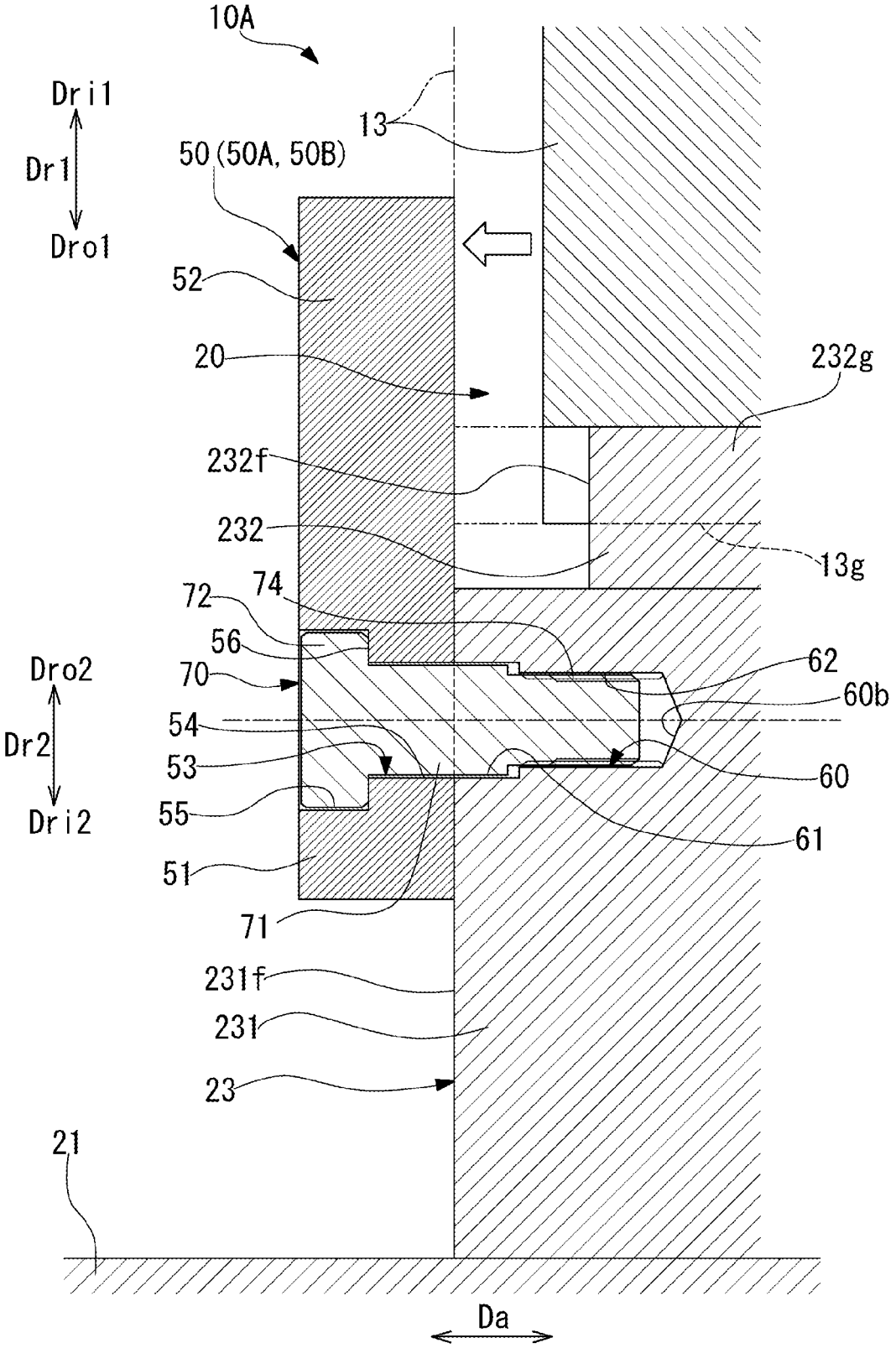
FIG. 4 is a cross-sectional view showing an attachment structure of the thrust collar according to the first embodiment of the present disclosure.

As shown in FIGS. 2 to 4, the pinion gear 23 integrally includes a gear base portion 231 and a tooth portion 232. The gear base portion 231 is formed on an outer side Dro2 in a second radial direction (radial direction) Dr2 with respect to the driven shaft 21. The gear base portion 231 is formed to protrude from an outer peripheral surface of the driven shaft 21 to the outer side Dro2 in the second radial direction Dr2 around the second central axis C2. The gear base portion 231 extends in a second circumferential direction (circumferential direction) Dc2 around the second central axis C2. Namely, the gear base portion 231 is formed in an annular shape around the driven shaft 21. The gear base portion 231 is a region of the pinion gear 23 in which gear teeth 232*g* to be described later are not formed.

The tooth portion 232 is formed to protrude to the outer side Dro2 in the second radial direction Dr2 with respect to the gear base portion 231. The tooth portion 232 includes a plurality of the gear teeth 232*g* formed at intervals in the second circumferential direction Dc2. The plurality of gear teeth 232*g* mesh with the plurality of wheel gear teeth 13*g*. Accordingly, the pinion gear 23 and the wheel gear 13 mesh with each other, and the rotation of the wheel gear 13 is transmitted to the pinion gear 23. The tooth portion 232 has a smaller thickness in the axial direction Da than that of the gear base portion 231. For this reason, the gear base portion 231 is formed to extend to both sides in the axial direction Da with respect to the tooth portion 232. In addition, the tooth portion 232 has a tooth portion end surface 232*f* facing the axial direction Da. The tooth portion end surface 232*f* forms a side surface of the tooth portion 232.

The pinion gear 23 and the wheel gear 13 increase a rotation speed of the drive shaft 12 driven by the external drive source, and transmits the increased speed to the driven shaft 21 via the pinion gear 23. Accordingly, the speed increase and transmission unit 20 is configured.

(Configuration of Impeller)

As shown in FIGS. 1 and 2, the impeller 25 is disposed at a different position in the axial direction Da with respect to the pinion gear 23. The impeller 25 is fixed to the driven shaft 21 at a position spaced apart from the radial bearings 22 in the axial direction Da. The impeller 25 rotates around the second central axis C2, together with the driven shaft 21. The impeller 25 of the present embodiment is fixed to the driven shaft 21 outside the pair of radial bearings 22 in the axial direction Da. Specifically, the impeller 25 includes a first impeller 25A disposed on a first side Da1 in the axial direction Da with respect to the pinion gear 23, and a second impeller 25B disposed on a second side Da2 in the axial direction Da with respect to the pinion gear 23. Each of the first impeller 25A and the second impeller 25B is fixed to an end portion of the driven shaft 21.

As shown in FIG. 2, in the present embodiment, the impeller 25 (the first impeller 25A and the second impeller 25B) is a so-called closed impeller including a disk 241, blades 242, and a cover 243. The impeller 25 may be an open impeller not including the cover 243.

The disk 241 has a disk shape. The disk 241 has a first surface 241*a* that is an end surface facing the end portion of the driven shaft 21, and a second surface 241*b* that is an end surface facing an end portion of the pinion gear 23, in the axial direction Da. The disk 241 is formed to gradually increase in outer diameter from the first surface 241*a* toward the second surface 241*b* in the axial direction Da. A surface of the disk 241, which faces the cover 243, is formed as a concave curved surface. A plurality of the blades 242 are formed on the concave curved surface of the disk 241 at intervals in a circumferential direction.

The cover 243 is formed to cover the plurality of blades 242. The cover 243 has a disk shape. A surface of the cover 243, which faces the disk 241, is formed as a convex surface curved surface facing the disk 241 with a certain interval therebetween.

In each of the impellers 25, an impeller flow path 245 is formed between the disk 241 and the cover 243. The impeller flow path 245 includes an inlet 245*i* that is open in the axial direction Da at a position close to the first surface 241*a* of the disk 241, and an outlet 245*o* that is open toward a radially outside of the impeller 25. The first impeller 25A and the second impeller 25B are disposed in opposite directions in the axial direction Da. Namely, the dispositions of the disk 241, the blades 242, and the cover 243 in the axial direction Da are opposite between the first impeller 25A and the second impeller 25B.

(Configuration of Casing)

As shown in FIG. 1, the casing 11 forms an intake flow path 18 and an exhaust flow path 19 around each of the impellers 25. The intake flow path 18 connects the outside of the casing 11 to the inlet 245*i* of the impeller 25. The exhaust flow path 19 connects the outlet 245*o* of the impeller 25 to the outside of the casing 11.

When the impeller 25 rotates together with the driven shaft 21, a working fluid (for example, air) is taken into the impeller flow path 245 from the intake flow path 18 through the inlet 245*i*. The working fluid is compressed while flowing from the inlet 245*i* of the impeller flow path 245 toward the outlet 245*o*. The compressed working fluid flows out from the outlet 245*o* to the radially outside of the impeller 25, and is sent to the exhaust flow path 19. The working fluid is sent from the exhaust flow path 19 to the outside of the casing 11.

A centrifugal compression unit 30 is formed of the impeller 25, the intake flow path 18, and the exhaust flow path 19. Accordingly, as shown in FIG. 1, the centrifugal compressor 10A includes a pair of the centrifugal compression units 30 disposed on both sides interposing the speed increase and transmission unit 20 therebetween. The pair of centrifugal compression units 30 include a first-stage centrifugal compression unit 30A disposed on the first side Da1 in the axial direction Da with the speed increase and transmission unit 20 interposed therebetween, and a second-stage centrifugal compression unit 30B disposed on the second side Da2 in the axial direction Da with the speed increase and transmission unit 20 interposed therebetween. Namely, the centrifugal compressor 10A is configured as a one-shaft two-stage compressor.

In the centrifugal compressor 10A, the working fluid compressed by the first impeller 25A of the first-stage centrifugal compression unit 30A and discharged from the exhaust flow path 19 subsequently flows into the intake flow path 18 of the second-stage centrifugal compression unit 30B. In the process of flowing through the second impeller 25B of the second-stage centrifugal compression unit 30B, the working fluid is further compressed to become the high-pressure working fluid.

(Configuration of Thrust Collar)

The thrust collar 50 restricts the movement of the driven shaft 21 and the pinion gear 23 in the axial direction Da. The thrust collar 50 can restrict the movement of the driven shaft 21 in the axial direction Da by colliding with the wheel gear 13 in the axial direction Da. As shown in FIGS. 1 and 2, the thrust collar 50 is fixed to the driven shaft 21. The thrust collar 50 is disposed between the pair of radial bearings 22 in the axial direction Da. The thrust collar 50 is disposed at an interval from the driven shaft 21 in the second radial direction Dr2. Namely, the thrust collar 50 is disposed on the outer side Dro2 in the second radial direction Dr2 with respect to the driven shaft 21. The thrust collar 50 is made of, for example, a material with the same strength as the driven shaft 21.

In addition, the thrust collar 50 is disposed adjacent to the pinion gear 23 in the axial direction Da. In the present embodiment, the thrust collar 50 is fixed to both sides in the axial direction Da of the pinion gear 23 with the pinion gear 23 interposed. The thrust collar 50 includes a first thrust collar 50A and a second thrust collar 50B. The first thrust collar 50A is disposed on the first side Da1 in the axial direction Da with respect to the pinion gear 23. The second thrust collar 50B is disposed on the second side Da2 in the axial direction Da with respect to the pinion gear 23. As shown in FIG. 2, an interval S between the first thrust collar 50A and the second thrust collar 50B in the axial direction Da is larger than a thickness T of the wheel gear 13 in the axial direction Da. The first thrust collar 50A and the second thrust collar 50B of the present embodiment have the same structure.

As shown in FIGS. 3 and 4, the thrust collar 50 (the first thrust collar 50A and the second thrust collar 50B) can come into contact with the wheel gear 13 in the axial direction Da on the outer side Dro2 in the second radial direction Dr2 with respect to the driven shaft 21. Specifically, the thrust collar 50 is disposed around the driven shaft 21 on the outer side Dro2 in the second radial direction Dr2 with respect to the driven shaft 21. The thrust collar 50 of the present embodiment is formed in a disk shape extending in the second circumferential direction Dc2. The thrust collar 50 is a flat plate member formed with a certain thickness. The thrust collar 50 integrally includes a first portion 51 and a second portion 52.

The first portion 51 is a region of the thrust collar 50, which is located on an inner side Dri2 in the second radial direction Dr2. The first portion 51 is in contact with the pinion gear 23 in the axial direction Da. The second portion 52 is a region of the thrust collar 50, which is located on the outer side Dro2 in the second radial direction Dr2 with respect to the first portion 51. The second portion 52 is formed to be able to come into contact with the wheel gear 13 in the axial direction Da. Namely, the second portion 52 is not always in contact with the wheel gear 13.

In addition, the thrust collar 50 has a plurality of bolt insertion holes 53 into which a plurality of the bolts 70 are each inserted. The plurality of bolt insertion holes 53 are formed in the first portion 51 at intervals in the second circumferential direction Dc2. Each of the bolt insertion holes 53 extends in the axial direction Da and penetrates through the thrust collar 50. Each of the bolt insertion holes 53 includes a shaft insertion portion 54 and a head accommodating portion 55.

The shaft insertion portion 54 is formed in the thrust collar 50 at a position close to the pinion gear 23 in the axial direction Da. A shaft portion 71 of the bolt 70 to be described later is inserted into the shaft insertion portion 54. The inner diameter of the shaft insertion portion 54 is formed to be larger than the outer diameter of the shaft portion 71.

The head accommodating portion 55 is formed at a position opposite to the pinion gear 23 with respect to the shaft insertion portion 54 in the axial direction Da. Namely, the head accommodating portion 55 is formed in the thrust collar 50 at a position farther away from the pinion gear 23 than the shaft insertion portion 54. The head accommodating portion 55 has a larger inner diameter than the inner diameter of the shaft insertion portion 54. The head accommodating portion 55 accommodates a head portion 72 of the bolt 70. The inner diameter of the head accommodating portion 55 is formed to be larger than the outer diameter of the head portion 72. The head accommodating portion 55 has a stepped surface 56 that is a flat surface facing a side opposite to the pinion gear 23 in the axial direction Da. The stepped surface 56 is a surface connected to the shaft insertion portion 54.

Figure 5:
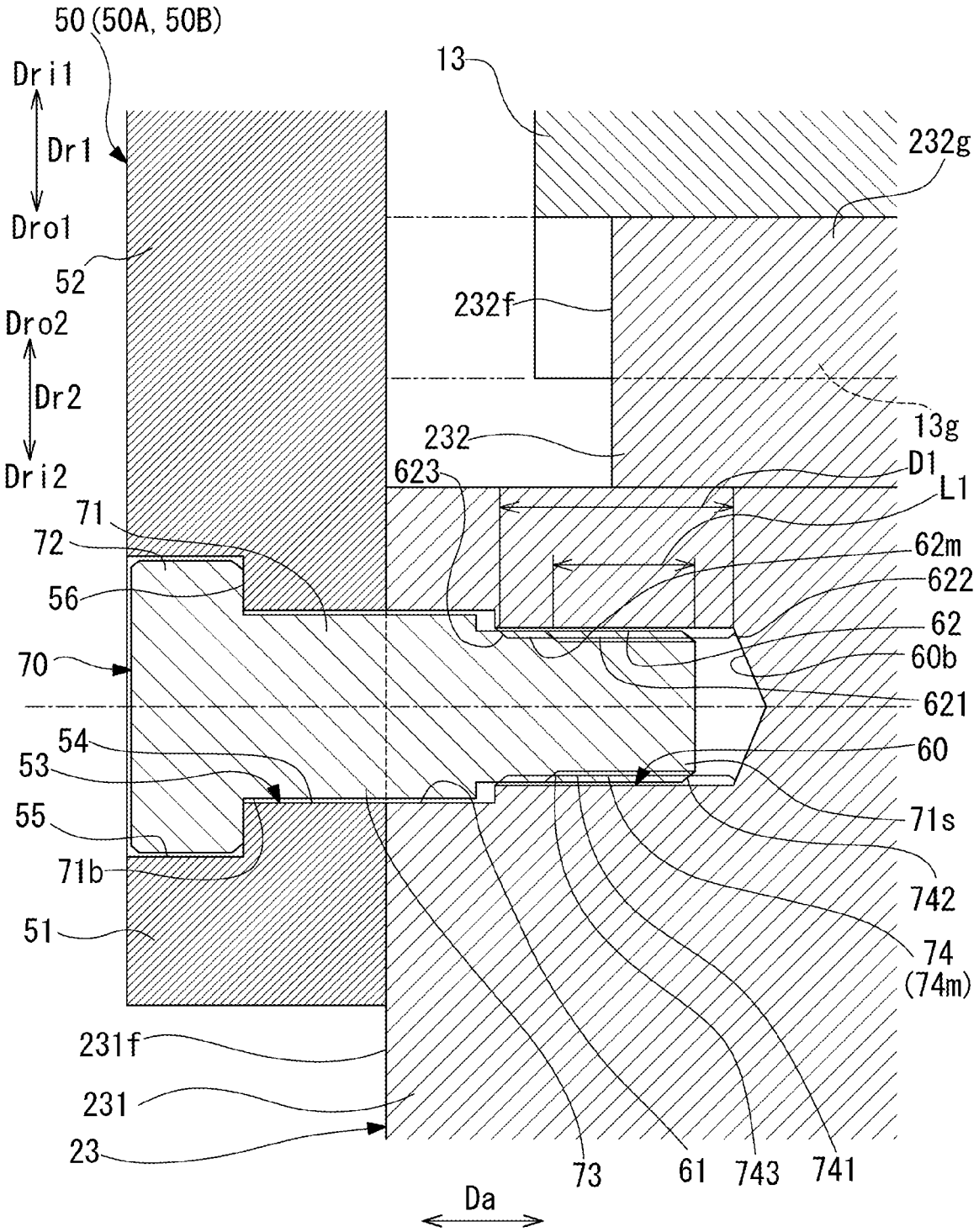
FIG. 5 is a cross-sectional view showing a state of meshing between a male screw shaft portion of a bolt for fixing the thrust collar and a female screw groove portion of a screw hole according to the first embodiment of the present disclosure.

In addition, as shown in FIGS. 4 and 5, the pinion gear 23 further has a plurality of screw holes 60 to which the plurality of bolts 70 are each fastened. The plurality of screw holes 60 are formed in a base portion end surface 231*f* of the gear base portion 231. The base portion end surface 231*f* is formed on the gear base portion 231 so as to face the thrust collar 50 in the axial direction Da. The base portion end surface 231*f* is a flat surface facing the first portion 51 in the axial direction Da. The base portion end surface 231*f* is a surface facing the same direction as the tooth portion end surface 232*f* in the axial direction Da. Each of the screw holes 60 is formed to be recessed from the base portion end surface 231*f* in the axial direction Da. The plurality of screw holes 60 are formed in the base portion end surface 231*f* at intervals in the second circumferential direction Dc2. Each of the screw holes 60 includes a tubular portion 61 and a female screw groove portion 62.

The tubular portion 61 is formed at a position close to the thrust collar 50 in the axial direction Da. The tubular portion 61 is connected to the base portion end surface 231*f*. The tubular portion 61 extends straight in the axial direction Da. The tubular portion 61 has a cylindrical shape having a certain outer diameter in the axial direction Da. The tubular portion 61 has substantially the same outer diameter as the shaft insertion portion 54. The tubular portion 61 does not include a female screw 62*m* to be described later.

The female screw groove portion 62 forms a bottom portion 60*b* of the screw hole 60 in the axial direction Da. The female screw groove portion 62 is connected to the tubular portion 61 on a side opposite to the base portion end surface 231*f* in the axial direction Da. The female screw groove portion 62 is formed in a part of a deep portion of the screw hole 60 in the axial direction Da, the deep portion including the bottom portion 60*b*. The inner diameter of the female screw groove portion 62 is set to be smaller than the inner diameter of the tubular portion 61.

As shown in FIG. 5, the female screw groove portion 62 includes a female screw portion 621, a bottom portion-side incomplete female screw portion 622, and an incomplete female screw portion 623. The female screw portion 621, the bottom portion-side incomplete female screw portion 622, and the incomplete female screw portion 623 are formed on an inner peripheral surface of the screw hole 60.

The female screw portion 621 includes the female screw 62*m* that is spirally formed along the inner peripheral surface of the screw hole 60. The female screw portion 621 is formed between the bottom portion-side incomplete female screw portion 622 and the incomplete female screw portion 623 in the axial direction Da. The female screw portion 621 includes portions in which both peaks and valleys of the female screw 62*m* form a complete mountain shape. The female screw portion 621 is disposed at a position overlapping the tooth portion end surface 232*f* of the tooth portion 232 in the axial direction Da. The bottom portion-side incomplete female screw portion 622 is formed to include the bottom portion 60*b* of the screw hole 60 in the axial direction Da. The incomplete female screw portion 623 is formed at a position close to the base portion end surface 231*f* with respect to the female screw portion 621 in the axial direction Da. The incomplete female screw portion 623 is formed on a side opposite to the bottom portion-side incomplete female screw portion 622 with the female screw portion 621 interposed therebetween in the axial direction Da. The incomplete female screw portion 623 is connected to the tubular portion 61. The female screw 62*m* is not formed on the bottom portion-side incomplete female screw portion 622 and the incomplete female screw portion 623. Each of the bottom portion-side incomplete female screw portion 622 and the incomplete female screw portion 623 includes a portion with an incomplete mountain shape created by a chamfering portion, biting portion, or the like of a processing tool for processing the female screw 62*m*.

The plurality of bolts 70 fix the thrust collar 50 (the first thrust collar 50A and the second thrust collar 50B) to the pinion gear 23. The plurality of bolts 70 are disposed at intervals in the second circumferential direction Dc2. The bolts 70 adjacent to each other in the second circumferential direction Dc2 are disposed at a certain interval from each other. The bolts 70 may be disposed in a quantity that allows the bolts 70 to receive a thrust force that the thrust collar 50 receives from the wheel gear 13. Therefore, for example, approximately two or three bolts 70 may be disposed per unit area. Each of the plurality of bolts 70 extends in the axial direction Da. The plurality of bolts 70 fix the thrust collar 50 and the pinion gear 23.

Each of the plurality of bolts 70 integrally includes the shaft portion 71 and the head portion 72. The shaft portion 71 extends in a columnar shape in the axial direction Da. The shaft portion 71 extends straight from a distal end portion 71*s* to a proximal end portion 71*b*. The head portion 72 is formed on the proximal end portion 71*b* of the shaft portion 71 in the axial direction Da. The head portion 72 is formed to expand toward the outer side Dro2 in the second radial direction Dr2 with respect to the shaft portion 71. The head portion 72 has, for example, a hexagonal shape when viewed in the axial direction Da, and is formed such that a tool such as a wrench or a spanner can engage with the head portion 72. The head portion 72 is accommodated in the head accommodating portion 55. The head portion 72 has a seating surface 72*f* facing the shaft portion 71 in the axial direction Da. The seating surface 72*f* is a surface of the head portion 72, on which the shaft portion 71 extends. The seating surface 72*f* is in contact with the stepped surface 56 in a state where the head portion 72 is accommodated in the head accommodating portion 55.

In addition, the shaft portion 71 is inserted into the shaft insertion portion 54 and the screw hole 60. The shaft portion 71 of the present embodiment includes a columnar portion 73 and a male screw shaft portion 74.

The columnar portion 73 is inserted into the shaft insertion portion 54 and the tubular portion 61. The columnar portion 73 forms a region including the proximal end portion 71*b* of the shaft portion 71 in the axial direction Da. Namely, the columnar portion 73 is connected to the head portion 72. The columnar portion 73 extends in the axial direction Da. The columnar portion 73 has a columnar shape having a certain outer diameter in the axial direction Da. The columnar portion 73 is formed with a size that allows the columnar portion 73 to be inserted into the shaft insertion portion 54 and the tubular portion 61 with a gap therebetween. The columnar portion 73 does not include a male screw 74*m* to be described later.

The male screw shaft portion 74 is inserted into the female screw groove portion 62. The male screw shaft portion 74 forms a region including the distal end portion 71*s* of the shaft portion 71 in the axial direction Da. The male screw shaft portion 74 is connected to the columnar portion 73 on a side opposite to the head portion 72 in the axial direction Da. A length L1 of the male screw shaft portion 74 in the axial direction Da is set to be smaller than a depth D1 of the female screw groove portion 62 of the screw hole 60 in the axial direction Da. The male screw shaft portion 74 is formed with a size that allows at least a part of an outer peripheral surface of the male screw shaft portion 74 to come into contact with an inner peripheral surface of the female screw groove portion 62. The male screw shaft portion 74 includes a male screw portion 741, a distal end-side incomplete male screw portion 742, and an incomplete male screw portion 743. The male screw portion 741, the distal end-side incomplete male screw portion 742, and the incomplete male screw portion 743 are formed on an outer peripheral surface of the shaft portion 71.

The male screw portion 741 includes the male screw 74*m* that is spirally formed along the outer peripheral surface of the male screw shaft portion 74. The male screw portion 741 is formed between the distal end-side incomplete male screw portion 742 and the incomplete male screw portion 743 in the axial direction Da. The male screw portion 741 includes portions in which both peaks and valleys of the male screw 74*m* form a complete mountain shape. The male screw portion 741 is disposed at a position overlapping the tooth portion end surface 232*f* of the tooth portion 232 in the axial direction Da. The distal end-side incomplete male screw portion 742 is formed to include the distal end portion 71*s* in the axial direction Da. The incomplete male screw portion 743 is formed at a position close to the head portion 72 with respect to the male screw portion 741 in the axial direction Da. The incomplete male screw portion 743 is formed on a side opposite to the distal end-side incomplete male screw portion 742 with the male screw portion 741 interposed therebetween in the axial direction Da. The incomplete male screw portion 743 is connected to the columnar portion 73. The male screw 74*m* is not formed on the distal end-side incomplete male screw portion 742 and the incomplete male screw portion 743. The distal end-side incomplete male screw portion 742 and the incomplete male screw portion 743 include portions with an incomplete mountain shape created by a chamfering portion, biting portion, or the like of a processing tool for processing the male screw 74*m*.

Each of the plurality of bolts 70 is inserted into the bolt insertion hole 53 from a position opposite to the wheel gear 13 with reference to the thrust collar 50 in the axial direction Da. Each of the bolts 70 is such that the shaft portion 71 is inserted into the screw hole 60 and the male screw shaft portion 74 meshes with the female screw groove portion 62. In this state, the head portion 72 of each of the bolts 70 is accommodated in the head accommodating portion 55. Since the head portion 72 of each of the bolts 70 is accommodated in the head accommodating portion 55, the head portion 72 does not protrude from the thrust collar 50 in the axial direction Da. In addition, the seating surface 72*f* of each of the bolts 70 collides with the stepped surface 56 of the thrust collar 50 in the axial direction Da.

In addition, the male screw portion 741 of each of the bolts 70 meshes with the female screw portion 621 inside the screw hole 60. The incomplete male screw portion 743 at a position close to the head portion 72 with respect to the male screw portion 741 is disposed at an interval in the axial direction Da from the incomplete female screw portion 623 at a position close to the head portion 72 with respect to the female screw portion 621. The incomplete male screw portion 743 is disposed at a position close to the bottom portion 60*b* of the screw hole 60 in the axial direction Da with respect to the incomplete female screw portion 623. Accordingly, the entirety of the male screw portion 741 in the axial direction Da meshes with the female screw portion 621 inside the screw hole 60.

Action Effects

In the centrifugal compressor 10A with the above-described configuration, when the wheel gear 13 rotates around the first central axis C1, together with the drive shaft 12, the pinion gear 23 meshing with the wheel gear 13 rotates around the second central axis C2, together with the driven shaft 21. The thrust collar 50 is fixed to be adjacent to the pinion gear 23 in the axial direction Da by the plurality of bolts 70. Specifically, in the present embodiment, when the centrifugal compressor 10A is assembled, the wheel gear 13 is disposed with respect to the pinion gear 23 such that the first thrust collar 50A and the second thrust collar 50B interpose the wheel gear 13 therebetween. The first thrust collar 50A and the second thrust collar 50B are fixed to the pinion gear 23 via the plurality of bolts 70. Accordingly, the first thrust collar 50A and the second thrust collar 50B are firmly fixed to the pinion gear 23 formed integrally with the driven shaft 21. Namely, the first thrust collar 50A and the second thrust collar 50B are indirectly fixed to the driven shaft 21 via the plurality of bolts 70 and the pinion gear 23.

The thrust collar 50 restricts the displacement of the driven shaft 21 in the axial direction Da by colliding with the wheel gear 13 in the axial direction Da. Specifically, in the centrifugal compressor 10A, each of the first impeller 25A and the second impeller 25B receives a reaction force from the working fluid to be compressed. Due to a balance between the magnitude of the reaction force that the first impeller 25A receives from the working fluid and the magnitude of the reaction force that the second impeller 25B receives from the working fluid, the pinion gear 23 and the driven shaft 21 may move to one side in the axial direction Da with respect to the wheel gear 13. As a result, when the wheel gear 13 collides with the thrust collar 50 in the axial direction Da, the thrust collar 50 receives a load in a direction away from the wheel gear 13. On the other hand, in a state where each of the plurality of bolts 70 is inserted from the position opposite to the wheel gear 13 with reference to the thrust collar 50 in the axial direction Da, each of the plurality of bolts 70 fixes the thrust collar 50 and the pinion gear 23. Accordingly, the load received by the thrust collar 50 can be distributed and borne by the plurality of bolts 70. At that time, the seating surface 72*f* of the head portion 72 is in contact with the stepped surface 56. For this reason, the load received by the thrust collar 50 can be effectively distributed to the plurality of bolts 70. Namely, even when the first thrust collar 50A and the second thrust collar 50B receive a load in the axial direction Da, a state where the first thrust collar 50A and the second thrust collar 50B are firmly fixed to the driven shaft 21 without using shrink fitting can be maintained. Therefore, while fixing the thrust collar 50 to the driven shaft 21 without using shrink fitting, it is possible to suppress a misalignment of the thrust collar 50, which has received a reaction force from the wheel gear 13, with respect to the driven shaft 21 in the axial direction Da.

As shown in FIG. 2, when the centrifugal compressor 10A is assembled, the pinion gear 23 is disposed to mesh with the wheel gear 13 at an intermediate portion between the first thrust collar 50A and the second thrust collar 50B. After the assembly is completed, in a steady operation state of the centrifugal compressor 10A of the present embodiment, a reaction force received by the second impeller 25B of the second-stage centrifugal compression unit 30B is larger than a reaction force received by the first impeller 25A. For this reason, in the first impeller 25A and the second impeller 25B, a force toward the second side Da2 in the axial direction Da is generated to be directed to the second impeller 25B in the axial direction Da. For this reason, the pinion gear 23 and the driven shaft 21 move to the second side Da2 in the axial direction Da with respect to the wheel gear 13, and the first thrust collar 50A approaches the wheel gear 13. Then, when the first thrust collar 50A comes into contact with the wheel gear 13, the further movement of the pinion gear 23 and the driven shaft 21 to the second side Da2 in the axial direction Da is restricted.

In addition, until the centrifugal compressor 10A reaches a steady operation after a start-up, due to a balance in the pressure of the working fluid inside the casing 11, a reaction force received by the first impeller 25A may be larger than a reaction force received by the second impeller 25B. In this case, the pinion gear 23 and the driven shaft 21 move to the first side Da1 in the axial direction Da with respect to the wheel gear 13. When the second thrust collar 50B comes into contact with the wheel gear 13, the further movement of the pinion gear 23 and the driven shaft 21 to the first side Da1 in the axial direction Da is restricted. In such a manner, therefore, in any operation state of the centrifugal compressor 10A, when the thrust collar 50 that is not shrink-fitted to the driven shaft 21 has received a reaction force from the wheel gear 13, the occurrence of a misalignment of the thrust collar 50 with respect to the driven shaft 21 can be effectively suppressed.

In addition, due to a load received by the thrust collar 50, a load in a bending direction and a load in a pulling direction act on the bolts 70. As a result, shear stress repeatedly acts on the bolts 70. Namely, when the load received by the thrust collar 50 is excessive, the bolts 70 undergo a shear fracture. Namely, before significant damage occurs in the thrust collar 50, the bolts 70 are damaged first. Therefore, in the event of maintenance or the like, only the bolts 70 need to be replaced without replacing the thrust collar 50. Therefore, maintainability can be improved.

In addition, the thrust collar 50 is fixed to the pinion gear 23 by the plurality of bolts 70 in a state where the first portion 51 is brought into contact with the pinion gear 23 in the axial direction Da. Then, the second portion 52 located on the outer side Dro2 in the second radial direction Dr2 with respect to the first portion 51 comes into contact with the wheel gear 13 in the axial direction Da. For this reason, in the thrust collar 50, the first portion 51 that is a region required for fixing to the pinion gear 23 and the second portion 52 that is a region required for contact with the wheel gear 13 are separately formed. Therefore, while the thrust collar 50 is fixed to the pinion gear 23 in a stable state, the thrust collar 50 can also be brought into contact with the wheel gear 13 in a stable state.

In addition, the gear base portion 231 to which the first portion 51 is fixed is formed on the outer side Dro2 in the second radial direction Dr2 with respect to the driven shaft 21. Accordingly, the thrust collar 50 and the pinion gear 23 can be fixed at positions shifted with respect to the driven shaft 21 in the second radial direction Dr2. Therefore, regardless of the shape of the driven shaft 21, the thrust collar 50 can be fixed to the pinion gear 23 by the plurality of bolts 70. In addition, the gear teeth 232*g* are not formed on the gear base portion 231. For this reason, the thrust collar 50 can be fixed to the pinion gear 23 without affecting meshing between the pinion gear 23 and the wheel gear 13.

In addition, each of the plurality of screw holes 60 includes the incomplete female screw portion 623 at a position close to the base portion end surface 231*f* of the gear base portion 231 with respect to the female screw portion 621. On the other hand, the shaft portion 71 of each of the plurality of bolts 70 includes the incomplete male screw portion 743 at a position close to the head portion 72 in the axial direction Da with respect to the male screw portion 741. The incomplete male screw portion 743 is disposed at an interval from the incomplete female screw portion 623 in the axial direction Da. Stress at a meshing portion between the bolt 70 and the screw hole 60 (portion at which the female screw portion 621 and the male screw portion 741 are fitted to each other) is likely to concentrate on a boundary portion between the female screw portion 621 and the incomplete female screw portion 623 of the screw hole 60 or on a boundary portion between the male screw portion 741 and the incomplete male screw portion 743 of the bolt 70. Since the incomplete male screw portion 743 is disposed at the interval from the incomplete female screw portion 623 in the axial direction Da, the portion on which stress concentrates in the bolt 70 and the screw hole 60 can be shifted in the axial direction Da. As a result, a fatigue fracture at the meshing portion between the bolt 70 and the screw hole 60 can be suppressed.

In addition, a force in the second radial direction Dr2 around the second central axis C2 and a force in the second circumferential direction Dc2 around the second central axis C2 act on the tooth portion end surface 232*f* of the pinion gear 23 due to meshing with the wheel gear 13. As a result, stress is likely to concentrate in the vicinity of the tooth portion end surface 232*f* of the pinion gear 23. On the other hand, in the present embodiment, the male screw portion 741 and the female screw portion 621 are disposed at a position overlapping the tooth portion end surface 232*f* in the axial direction Da. Namely, the incomplete male screw portion 743 and the incomplete female screw portion 623 are disposed at positions away from the tooth portion end surface 232*f* in the axial direction Da. Therefore, in a state where the bolts 70 are firmly fixed to the screw holes a stress concentration on a portion at which the pinion gear 23 and the thrust collar 50 are fixed can be suppressed by the plurality of bolts 70.

In addition, each of the plurality of bolts 70 is such that the shaft portion 71 is inserted into the shaft insertion portion 54 and the head portion 72 is accommodated in the head accommodating portion 55. Accordingly, the protrusion of the bolt 70 from the thrust collar 50 to the side opposite to the pinion gear 23 in the axial direction Da can be suppressed. In a case where a part of the bolt 70 such as the head portion 72 has protruded from the thrust collar 50, when the thrust collar 50 rotates together with the driven shaft 21, the protruding part of the bolt 70 receives stirring resistance due to a fluid such as lubricant inside the centrifugal compressor 10A. As a result, a large load is generated on the bolt 70 and pressure loss occurs. On the other hand, by accommodating the head portion 72 of the bolt 70 in the head accommodating portion 55, a load on the bolt 70 can be suppressed, and pressure loss can be suppressed.

in addition, as the thrust collar 50, the first thrust collar 50A disposed on the first side Da1 in the axial direction Da with respect to the pinion gear 23 and the second thrust collar 50B disposed on the second side Da2 in the axial direction Da with respect to the pinion gear 23 are disposed. Accordingly, even when the pinion gear 23 and the driven shaft 21 move to one of the first side Da1 and the second side Da2 in the axial direction Da, the wheel gear 13 collides with the first thrust collar 50A or the second thrust collar 50B. For this reason, regardless of a movement direction of the pinion gear 23 and the driven shaft 21, the movement of the pinion gear 23 and the driven shaft 21 in the axial direction Da can be restricted.

In addition, the interval S between the first thrust collar 50A and the second thrust collar 50B in the axial direction Da is larger than the thickness T of the wheel gear 13 in the axial direction Da. For this reason, when the centrifugal compressor 10A is assembled, the first thrust collar 50A and the second thrust collar 50B are less likely to interfere with the pinion gear 23 or the wheel gear 13. Accordingly, the pinion gear 23 and the wheel gear 13 can easily mesh with each other, and workability when the centrifugal compressor 10A is assembled can be improved.

Second Embodiment

Next, a second embodiment of a centrifugal compressor 10B according to the present disclosure will be described. In the second embodiment to be described below, in the drawings, the same reference signs are given to the configurations common to the first embodiment, and a description thereof will be omitted. In the first embodiment, the thrust collar 50 is fixed in a state where the thrust collar 50 has collided with the base portion end surface 231*f* that is a flat surface. However, the base portion end surface 231*f* of the pinion gear 23 is not limited to being configured as only a smooth surface as in the first embodiment.

Figure 6:
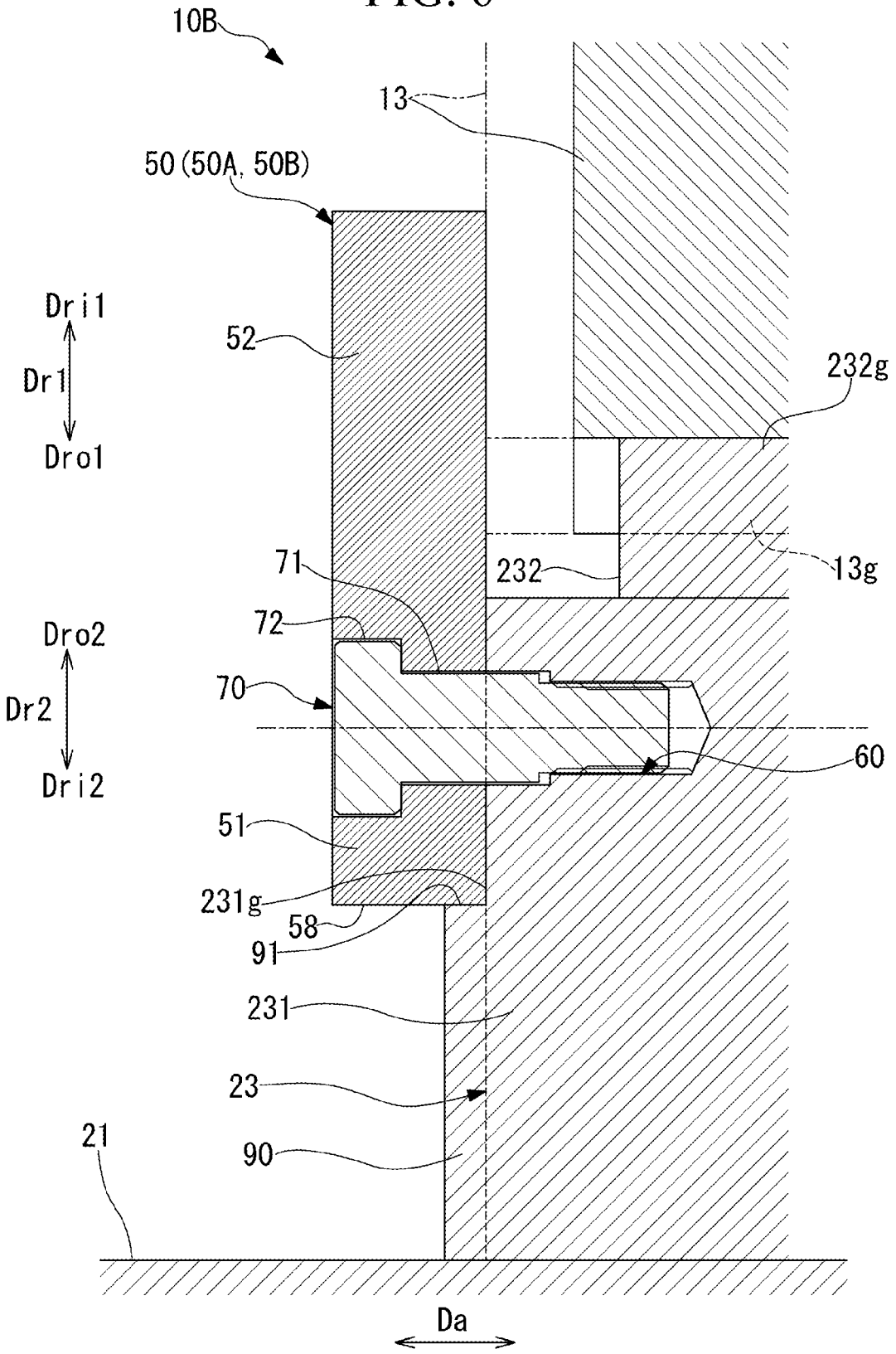
FIG. 6 is a cross-sectional view showing an attachment structure of a thrust collar according to a second embodiment of the present disclosure.

In the second embodiment, for example, as shown in FIG. 6, a boss 90 is formed integrally with the pinion gear 23 of the centrifugal compressor 10B. The boss 90 protrudes from a base portion end surface 231*g* toward the thrust collar 50 in the axial direction Da. The boss 90 extends around the second circumferential direction Dc2. The outer diameter of the boss 90 is substantially the same as the inner diameter of the thrust collar 50 having an annular shape. The boss 90 has an abutting surface 91 facing the outer side Dro2 in the second radial direction Dr2. An inner peripheral surface 58 of the thrust collar 50, which faces the inner side Dri2 in the second radial direction Dr2, is located on the outer side Dro2 in the second radial direction Dr2 with respect to the abutting surface 91. The inner peripheral surface 58 abuts against the abutting surface 91.

Action Effects

With such a configuration, the thrust collar 50 is fixed to the pinion gear 23 in a state where the inner peripheral surface 58 is in contact with the abutting surface 91. For this reason, when the thrust collar 50 is fixed to the pinion gear 23, the movement of the thrust collar 50 to the inner side Dri2 in the second radial direction Dr2 can be restricted. Therefore, when the thrust collar 50 is fixed to the pinion gear 23, the position of the thrust collar 50 in the second radial direction Dr2 with respect to the pinion gear 23 can be positioned with high accuracy.

Modification Example of Second Embodiment

Figure 7:
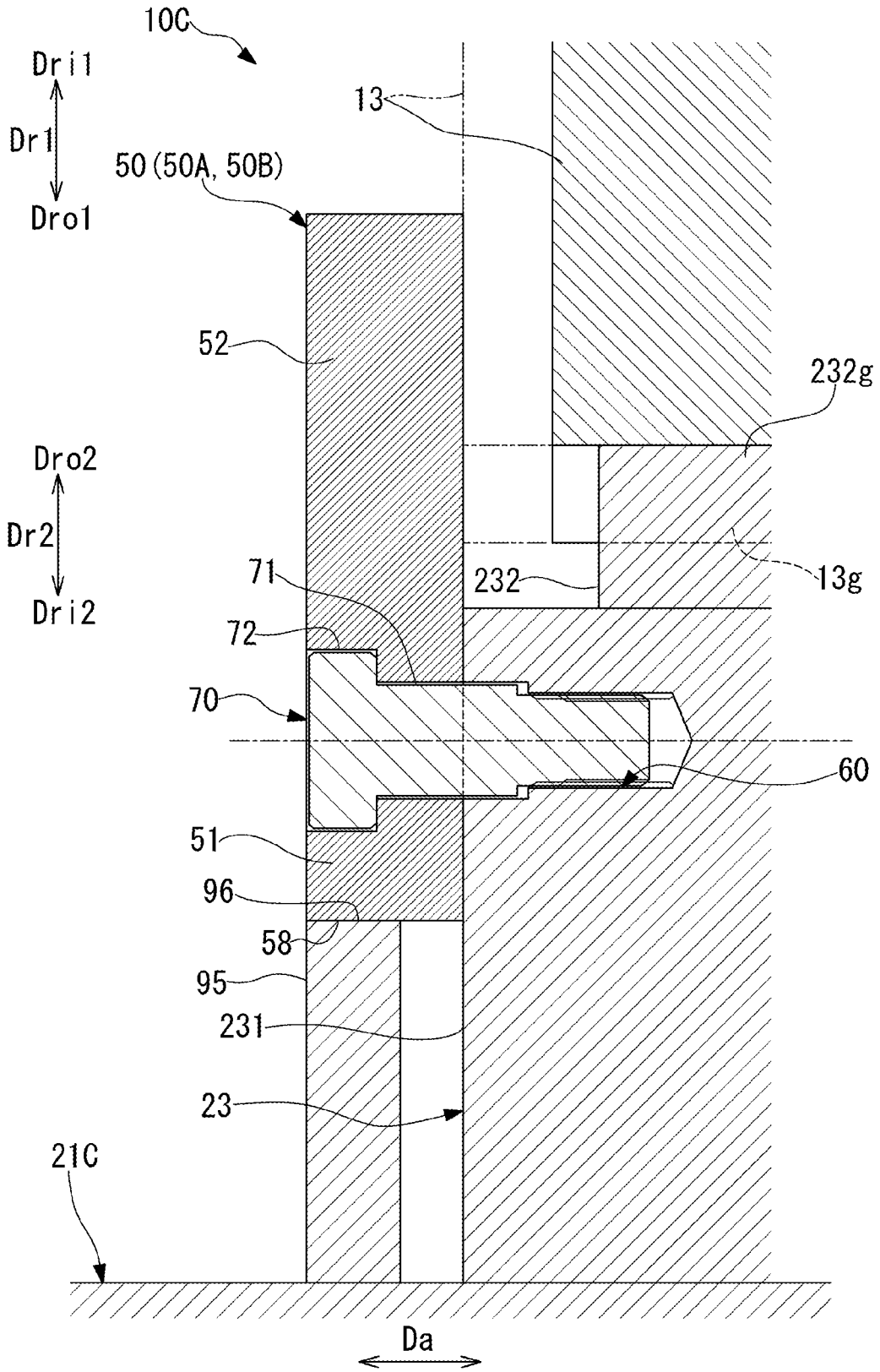
FIG. 7 is a cross-sectional view showing an attachment structure of a thrust collar according to a modification example of the second embodiment of the present disclosure.

In addition, the abutting surface is not limited to the structure formed on the pinion gear 23. In a modification example, the abutting surface is formed on a driven shaft 21C. As shown in FIG. 7, a projection portion 95 is formed integrally with the driven shaft 21C of a centrifugal compressor 10C of the modification example. The projection portion 95 protrudes from an outer peripheral surface of the driven shaft 21C to the outer side Dro2 in the second radial direction Dr2. The projection portion 95 extends in an annular shape around the second circumferential direction Dc2. The outer diameter of the projection portion 95 is substantially the same as the inner diameter of the thrust collar 50 having an annular shape. The projection portion 95 has an abutting surface 96 facing the outer side Dro2 in the second radial direction Dr2. The inner peripheral surface 58 of the thrust collar 50 is located on the outer side Dro2 in the second radial direction Dr2 with respect to the abutting surface 96. The inner peripheral surface 58 abuts against the abutting surface 96.

Action Effects

Even with such a configuration, the thrust collar 50 is fixed to the pinion gear 23 in a state where the inner peripheral surface 58 is in contact with the abutting surface 96. For this reason, when the thrust collar 50 is fixed to the pinion gear 23, the movement of the thrust collar 50 to the inner side Dri2 in the second radial direction Dr2 can be restricted. Therefore, when the thrust collar 50 is fixed to the pinion gear 23, the position of the thrust collar 50 in the second radial direction Dr2 with respect to the pinion gear 23 can be positioned with high accuracy.

Each of the boss 90 and the projection portion 95 is formed in an annular shape so as to be continuous in the second circumferential direction Dc2, but is not limited to having such a shape. Three or more of bosses 90 and projection portions 95 may be formed at intervals around the second circumferential direction Dc2. Therefore, a plurality of the abutting surfaces 91 and 96 may be formed at intervals in the second circumferential direction Dc2.

Third Embodiment

Next, a third embodiment of a centrifugal compressor 10D according to the present disclosure will be described. In addition, in the third embodiment to be described below, in the drawings, the same reference signs are given to the configurations common to the first embodiment and second embodiment, and a description thereof will be omitted. In the first embodiment, the thrust collar 50 is formed as a flat plate member having an annular shape and extending in the second circumferential direction Dc2; however, the shape of the thrust collar 50 is not limited to such a shape.

Figure 8:
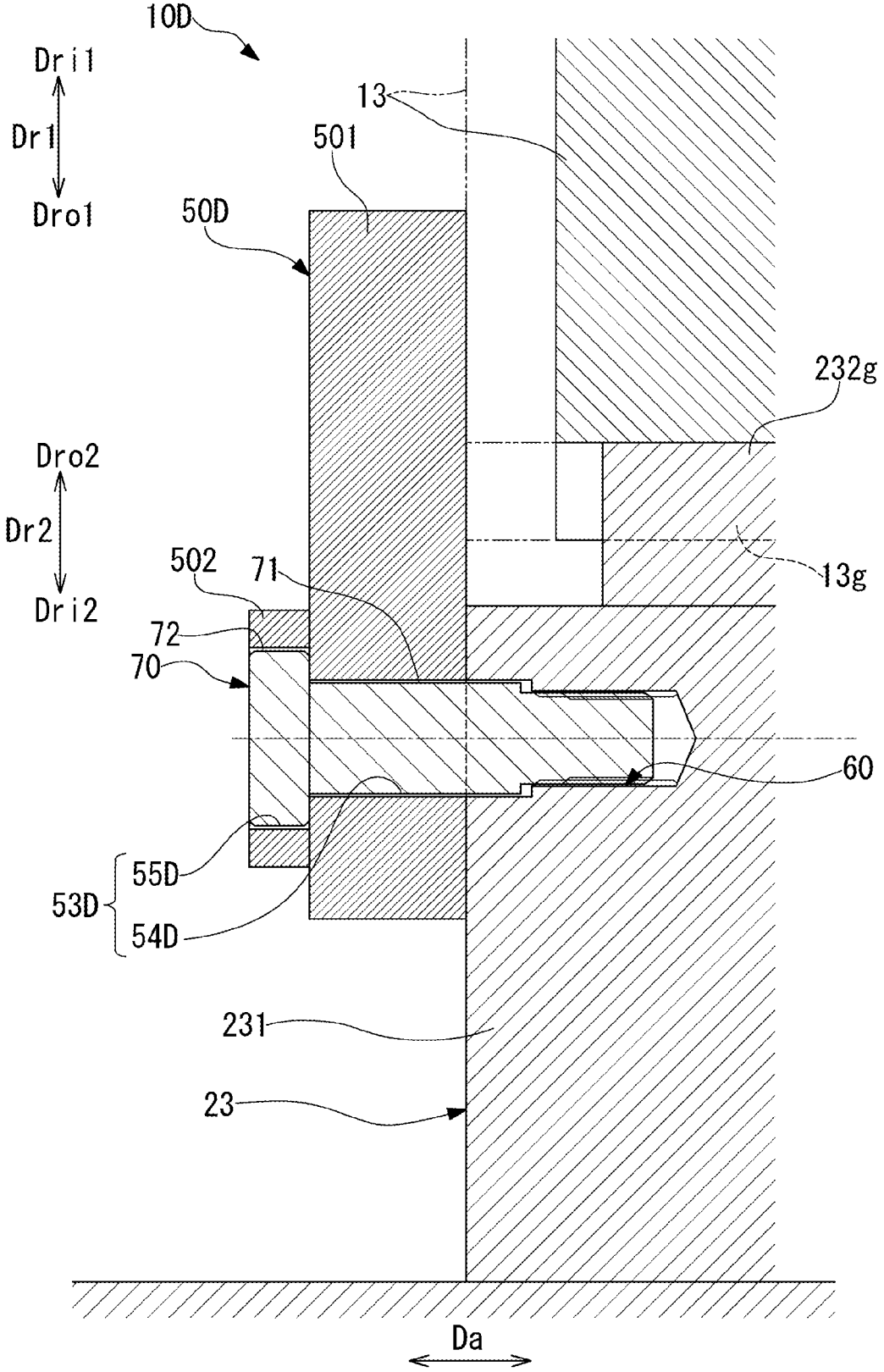
FIG. 8 is a cross-sectional view showing an attachment structure of a thrust collar according to a third embodiment of the present disclosure.

In the third embodiment, for example, as shown in FIG. 8, a thrust collar 50D of the centrifugal compressor 10D integrally includes a main collar portion 501 and a protruding portion 502. Similarly to the thrust collar 50 in the above-described embodiments, the main collar portion 501 is formed in a disk shape having a certain thickness and extending in the second circumferential direction Dc2. A shaft insertion portion 54D is formed in the main collar portion 501. The protruding portion 502 protrudes from the main collar portion 501 in the axial direction Da. The protruding portion 502 extends in the second circumferential direction Dc2, and has an annular shape when viewed in the axial direction Da. The protruding portion 502 is formed with a smaller diameter than that of the main collar portion 501 when viewed in the axial direction Da. The protruding portion 502 is formed at a position overlapping the shaft insertion portion 54D when viewed in the axial direction Da. The protruding portion 502 is formed at a position toward the inner side Dri2 in the second radial direction Dr2 with respect to the total length in the second radial direction Dr2 of the main collar portion 501 when viewed in the axial direction Da. A head accommodating portion is formed in the protruding portion 502.

Action Effects

With such a configuration, the head accommodating portion 55D is formed in the protruding portion 502 protruding from the main collar portion 501 in the axial direction Da. Namely, the head accommodating portion 55D is not formed in the main collar portion 501. The inner diameter of the head accommodating portion 55D accommodating the head portion 72 is larger than the inner diameter of the shaft insertion portion MD. For example, when both the head accommodating portion 55D and the shaft insertion portion 54D are formed in the main collar portion 501, in the main collar portion 501, the weight differs in the axial direction Da between a side on which the shaft insertion portion 54D is formed and a side on which the head accommodating portion is formed, so that an imbalance is likely to occur. As a result, there is a high possibility that due to a reaction force from the wheel gear 13, the main collar portion 501 is tilted to lean in the axial direction Da with the disposition position of the bolt 70 as a starting point. Namely, the posture of the main collar portion 501 collapses and the load on the bolt 70 increases. On the other hand, by forming the head accommodating portion 55D in the protruding portion 502, only the shaft insertion portion 54D with a certain inner diameter is formed in the main collar portion 501. For this reason, the collapse of the weight balance in the axial direction Da of the main collar portion 501 can be suppressed. Further, the protruding portion 502 protrudes from the main collar portion 501 in the axial direction Da. For this reason, in the entirety of the thrust collar 50D, the center of gravity is shifted to a position toward the protruding portion 502 in the axial direction Da and the second radial direction Dr2. As a result, even when a force that causes the thrust collar 50D to lean is generated due to a reaction force from the wheel gear 13, the thrust collar 50D is less likely to tilt. For this reason, the thrust collar 50D can be maintained in a stable posture, and a load on the bolt 70 can be suppressed.

Fourth Embodiment

Next, a fourth embodiment of a centrifugal compressor 10E according to the present disclosure will be described. In addition, in the fourth embodiment to be described below, in the drawings, the same reference signs are given to the configurations common to the first embodiment and third embodiment, and a description thereof will be omitted. In the above-described embodiments, the plurality of bolts 70 are configured to be fixed to the pinion gear 23; however, the fixing structure of the bolts 70 is not limited to such a configuration.

Figure 9:
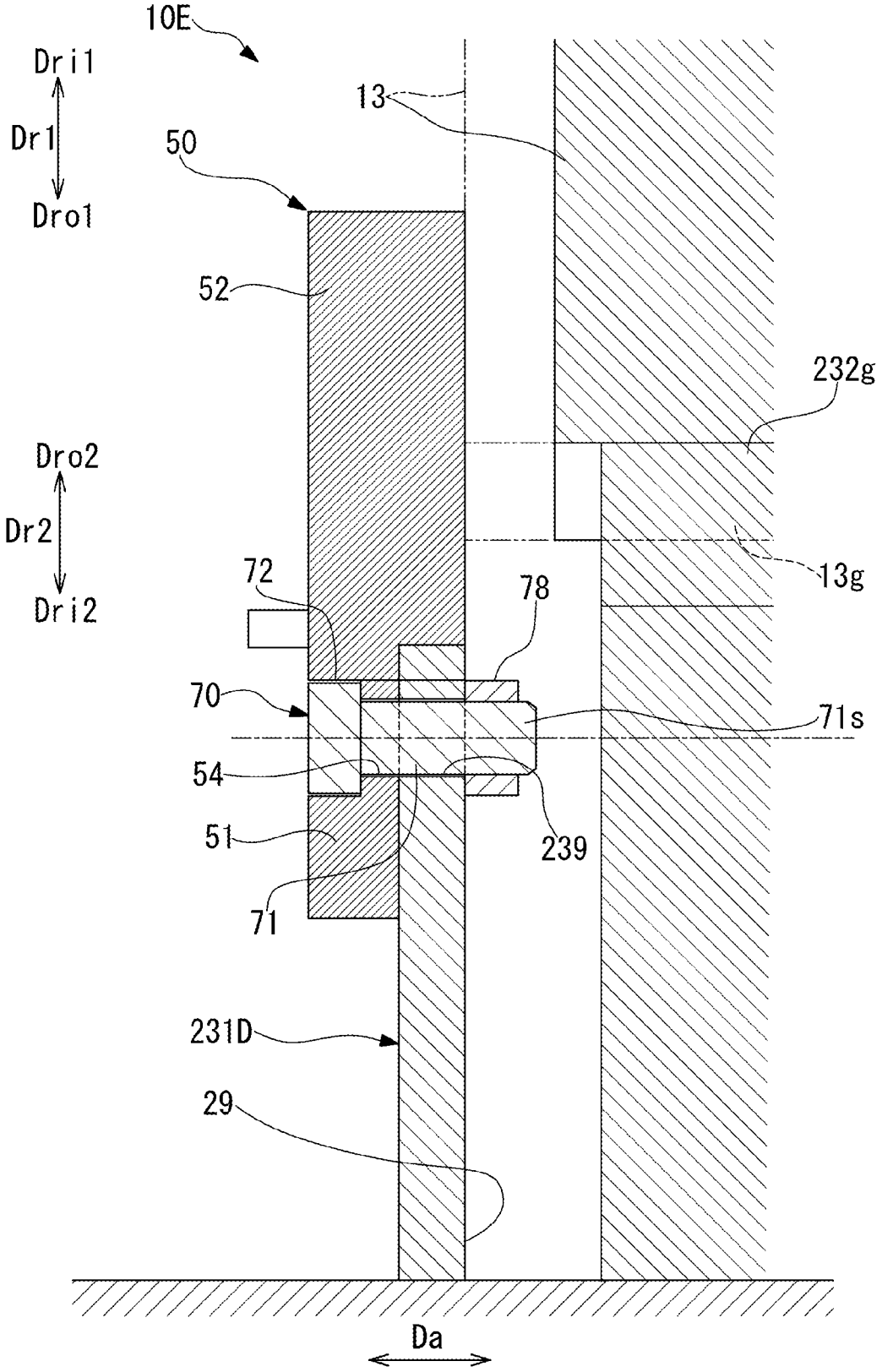
FIG. 9 is a cross-sectional view showing an attachment structure of a thrust collar according to a fourth embodiment of the present disclosure.

For example, as shown in FIG. 9, in the centrifugal compressor 10E of the fourth embodiment, the bolt 70 is fixed by a nut 78. Specifically, a pinion gear 23E of the centrifugal compressor 10E includes a recessed portion 29 recessed from an outer peripheral surface of a gear base portion 231D to the inner side Dri2 in the second radial direction Dr2. The recessed portion 29 is formed to be continuous in the second circumferential direction Dc2. A thrust collar 50E is such that the first portion 51 abuts against the gear base portion 231D from a side opposite to the pinion gear 23E with respect to the recessed portion 29 in the axial direction Da. A plurality of through-holes 239 penetrating in the axial direction Da are formed in the gear base portion 231D. Each of the plurality of bolts 70 is such that the shaft portion 71 penetrates through the shaft insertion portion 54 of the thrust collar 50E and through the through-hole 239. The distal end portion 71*s* of the bolt 70 protrudes into the recessed portion 29. The nut 78 is fitted to the distal end portion 71*s* of the shaft portion 71 inside the recessed portion 29.

In such a manner, the thrust collar 50E may be fixed to the pinion gear 23E by the plurality of bolts 70 and the nuts 78. Since the screw holes 60 are not formed in the pinion gear 23E, there is no load on the pinion gear 23E from the bolts 70 caused by fitting between the bolts 70 and the pinion gear 23E. For this reason, damage to the pinion gear 23E can be suppressed.

Other Embodiments

The embodiments of the present disclosure have been described above in detail with reference to the drawings; however, specific configurations are not limited to those of the embodiments, and design changes and the like within the concept of the present disclosure can also be included.

In the above-described embodiments, by providing only one set of the pinion gear 23 and the driven shaft 21 on the outer side Dro1 in the first radial direction Dr1 of the wheel gear 13, the centrifugal compressors 10A to 10E are configured as one-shaft two-stage centrifugal compressors; however, the present disclosure is not limited to the configuration. For example, a plurality of sets of the pinion gears 23 and the driven shafts 21 may be disposed on the outer side Dro1 in the first radial direction Dr1 of the wheel gear 13 at intervals around the first circumferential direction Dc1. At that time, the thrust collar 50 may be disposed on the entirety of the driven shaft 21 or the thrust collar 50 may be disposed on only a part of the driven shaft 21.

Additional Notes

For example, the centrifugal compressors 10A to 10E described in the embodiments are understood as follows.

(1) According to a first aspect, there are provided centrifugal compressors 10A to 10E, each including: a drive shaft 12 extending along a first central axis C1 and rotatable around the first central axis C1; a wheel gear 13 rotating around the first central axis C1, together with the drive shaft 12; a driven shaft 21 disposed parallel to the drive shaft 12, extending in an axial direction Da in which the first central axis C1 extends, and rotatable around a second central axis C2; a pinion gear 23 disposed to be rotatable around the second central axis C2, together with the driven shaft 21, and meshing with the wheel gear 13; an impeller 25 that is disposed at a different position in the axial direction Da with respect to the pinion gear 23, and that compresses a working fluid by rotating around the second central axis C2, together with the driven shaft 21; a thrust collar 50 disposed adjacent to the pinion gear 23 in the axial direction Da, and restricting a displacement of the driven shaft 21 in the axial direction Da by colliding with the wheel gear 13 in the axial direction Da on an outer side Dro2 in a radial direction Dr2, which around the second central axis C2, with respect to the driven shaft 21; and a plurality of bolts 70 disposed at intervals in a circumferential direction Dc2, which around the second central axis C2, each extending in the axial direction Da, and fixing the thrust collar 50 and the pinion gear 23. Each of the plurality of bolts 70 fix the thrust collar 50 and the pinion gear 23 in a state where each of the plurality of bolts 70 is inserted from a position opposite to the wheel gear 13 with reference to the thrust collar 50 in the axial direction Da.

In the centrifugal compressors 10A to 10E, due to a balance between the magnitudes of reaction forces that the impeller 25 receives from the working fluid, the pinion gear 23 and the driven shaft 21 may move to one side in the axial direction Da with respect to the wheel gear 13. As a result, when the wheel gear 13 collides with the thrust collar 50 in the axial direction Da, the thrust collar 50 receives a load in a direction away from the wheel gear 13. On the other hand, in a state where each of the plurality of bolts 70 is inserted from the position opposite to the wheel gear 13 with reference to the thrust collar 50 in the axial direction Da, each of the plurality of bolts 70 fixes the thrust collar 50 and the pinion gear 23. Accordingly, the load received by the thrust collar 50 can be distributed and borne by the plurality of bolts 70. Namely, even when the thrust collar 50 receives a load in the axial direction Da, a state where the thrust collar is firmly fixed to the driven shaft 21 without using shrink fitting can be maintained. Therefore, while fixing the thrust collar 50 to the driven shaft 21 without using shrink fitting, it is possible to suppress a misalignment of the thrust collar 50, which has received a reaction force from the wheel gear 13, with respect to the driven shaft 21 in the axial direction Da.

(2) According to the centrifugal compressors 10A to 10E of a second aspect, in the centrifugal compressors 10A to 10E described in (1), the thrust collar 50 is formed such that a first portion 51 located on an inner side in the radial direction Dr2 is allowed to come into contact with the pinion gear 23 in the axial direction Da and a second portion 52 located on the outer side Dro2 in the radial direction Dr2 with respect to the first portion 51 is allowed to come into contact with the wheel gear 13 in the axial direction Da.

Accordingly, in the thrust collar 50, the first portion 51 that is a region required for fixing to the pinion gear 23 and the second portion 52 that is a region required for contact with the wheel gear 13 are separately formed. Therefore, while the thrust collar 50 is fixed to the pinion gear 23 in a stable state, the thrust collar 50 can also be brought into contact with the wheel gear 13 in a stable state.

(3) According to the centrifugal compressors 10A to 10E of a third aspect, in the centrifugal compressors 10A to 10E described in (2), the pinion gear 23 includes a gear base portion 231 formed on the outer side Dro2 in the radial direction Dr2 with respect to the driven shaft 21 and extending in the circumferential direction Dc2, and a tooth portion 232 protruding to the outer side Dro2 in the radial direction Dr2 with respect to the gear base portion 231 and including a plurality of gear teeth 232*g* formed at intervals in the circumferential direction Dc2. The first portion 51 is fixed to the gear base portion 231 by the plurality of bolts 70.

Accordingly, the thrust collar 50 and the pinion gear 23 can be fixed at positions shifted with respect to the driven shaft 21 in the radial direction. Therefore, regardless of the shape of the driven shaft 21, the thrust collar 50 can be fixed to the pinion gear 23 by the plurality of bolts 70. In addition, the gear teeth 232*g* are not formed on the gear base portion 231. For this reason, the thrust collar 50 can be fixed to the pinion gear 23 without affecting meshing between the pinion gear 23 and the wheel gear 13.

(4) According to the centrifugal compressors 10A to 10E of a fourth aspect, in the centrifugal compressors 10A to 10E described in (3), the pinion gear 23 includes a plurality of screw holes 60 formed in the gear base portion 231 at intervals in the circumferential direction Dc2. Each of the plurality of screw holes 60 is recessed to extend from a base portion end surface 231*f* of the gear base portion 231 in the axial direction Da, the base portion end surface 231*f* facing the axial direction Da. Each of the plurality of screw holes 60 includes a female screw portion 621 and an incomplete female screw portion 623 on an inner peripheral surface, the incomplete female screw portion 623 being formed at a position close to the base portion end surface 231*f* with respect to the female screw portion 621 in the axial direction Da. Each of the plurality of bolts 70 includes a shaft portion 71 extending in the axial direction Da and including a male screw portion 741 on an outer peripheral surface, the male screw portion 741 meshing with the female screw portion 621, and a head portion 72 formed on an end portion of the shaft portion 71 and formed to expand toward the outer side Dro2 in the radial direction Dr2 with respect to the shaft portion 71. The shaft portion 71 includes an incomplete male screw portion 743 disposed at a position close to the head portion 72 with respect to the male screw portion 741 in the axial direction Da and at an interval from the incomplete female screw portion 623 in the axial direction Da.

Stress at a meshing portion between the bolt 70 and the screw hole 60 (portion at which the female screw portion 621 and the male screw portion 741 are fitted to each other) is likely to concentrate on a boundary portion between the female screw portion 621 and the incomplete female screw portion 623 of the screw hole 60 or on a boundary portion between the male screw portion 741 and the incomplete male screw portion 743 of the bolt 70. Since the incomplete male screw portion 743 is disposed at the interval from the incomplete female screw portion 623 in the axial direction Da, the portion on which stress concentrates in the bolt 70 and the screw hole 60 can be shifted in the axial direction Da. As a result, a fatigue fracture at the meshing portion between the bolt 70 and the screw hole 60 can be suppressed.

(5) According to the centrifugal compressors 10A to 10E of a fifth aspect, in the centrifugal compressors 10A to 10E described in (4), the tooth portion 232 has a tooth portion end surface 232*f* facing the same side as the base portion end surface 231*f* in the axial direction Da. The male screw portion 741 and the female screw portion 621 are disposed at a position overlapping the tooth portion end surface 232*f* in the axial direction Da.

Accordingly, the incomplete male screw portion 743 and the incomplete female screw portion 623 are disposed at positions away from the tooth portion end surface 232*f* in the axial direction Da. Therefore, in a state where the bolts 70 are firmly fixed to the screw holes 60, a stress concentration on a portion at which the pinion gear 23 and the thrust collar 50 are fixed can be suppressed by the plurality of bolts 70.

(6) According to the centrifugal compressors 10A to 10E of a sixth aspect, in the centrifugal compressors 10A to 10E described in (4) or (5), the thrust collar 50 has a plurality of bolt insertion holes 53 into which the plurality of bolts 70 are each inserted. Each of the plurality of bolt insertion holes 53 include a shaft insertion portion 54 into which the shaft portion 71 is inserted, and a head accommodating portion 55 formed on a side opposite to the pinion gear 23 with respect to the shaft insertion portion 54 in the axial direction Da, and accommodating the head portion 72.

Accordingly, the protrusion of the bolt 70 from the thrust collar 50 to the side opposite to the pinion gear 23 in the axial direction Da can be suppressed. In a case where a part of the bolt 70 such as the head portion 72 has protruded from the thrust collar 50, when the thrust collar 50 rotates together with the driven shaft 21, the protruding part of the bolt 70 receives stirring resistance due to a fluid such as lubricant inside the centrifugal compressors 10A to 10E. As a result, a large load is generated on the bolt 70 and pressure loss occurs. On the other hand, by accommodating the head portion 72 of the bolt 70 in the head accommodating portion 55, a load on the bolt 70 can be suppressed, and pressure loss can be suppressed.

(7) According to the centrifugal compressor 10D of a seventh aspect, in the centrifugal compressor 10D described in (6), the thrust collar 50D includes a main collar portion 501 in which the shaft insertion portion 54D is formed, and a protruding portion 502 formed with a smaller diameter than a diameter of the main collar portion 501 when viewed in the axial direction Da, and protruding from the main collar portion 501 in the axial direction Da. The head accommodating portion 55D is formed in the protruding portion 502.

Accordingly, the protruding portion 502 protrudes from the main collar portion 501 in the axial direction Da. For this reason, in the entirety of the thrust collar 50D, the center of gravity is shifted to a position toward the protruding portion 502 in the axial direction Da and the radial direction. As a result, even when a force that causes the thrust collar 50D to lean is generated due to a reaction force from the wheel gear 13, the thrust collar 50D is less likely to tilt. For this reason, the thrust collar 50D can be maintained in a stable posture, and a load on the bolt 70 can be suppressed.

(8) According to the centrifugal compressor 10E of an eighth aspect, in the centrifugal compressor 10E described in any one of (1) to (7), the pinion gear 23E includes a recessed portion 29 recessed from an outer peripheral surface of the pinion gear to an inner side in the radial direction Dr2. The thrust collar 50E is fixed to the pinion gear 23E by the plurality of bolts 70 and nuts 78 accommodated in the recessed portion 29 to be fitted to the plurality of bolts 70.

Accordingly, since the screw holes 60 are not formed in the pinion gear 23E, there is no load on the pinion gear 23E from the bolts 70 caused by fitting between the bolts 70 and the pinion gear 23E. For this reason, damage to the pinion gear 23E can be suppressed.

(9) According to the centrifugal compressors 10B and 10C of a ninth aspect, in the centrifugal compressors 10B and 10C described in any one of (1) to (8), the thrust collar 50 is formed in an annular shape extending in the circumferential direction Dc2. The pinion gear 23 or the driven shaft 21 has an abutting surface 91 or 96 facing the outer side Dro2 in the radial direction Dr2 and abutting against an inner peripheral surface 58 of the thrust collar 50.

Accordingly, the thrust collar 50 is fixed to the pinion gear 23 in a state where the inner peripheral surface 58 is in contact with the abutting surface 91. For this reason, when the thrust collar 50 is fixed to the pinion gear 23, the movement of the thrust collar 50 in the radial direction can be restricted. Therefore, when the thrust collar 50 is fixed to the pinion gear 23, the position of the thrust collar 50 in the radial direction with respect to the pinion gear 23 can be positioned with high accuracy.

(10) According to the centrifugal compressors 10A to 10E of a tenth aspect, in the centrifugal compressors 10A to 10E described in any one of (1) to (9), the impeller 25 includes a first impeller 25A disposed on a first side Da1 in the axial direction Da with respect to the pinion gear 23, and a second impeller 25B disposed on a second side Da2 in the axial direction Da with respect to the pinion gear 23. The thrust collar 50 includes a first thrust collar 50A disposed on the first side Da1 in the axial direction Da with respect to the pinion gear 23, and a second thrust collar 50B disposed on the second side Da2 in the axial direction Da with respect to the pinion gear 23.

Accordingly, even when the pinion gear 23 and the driven shaft 21 move to one side in the axial direction Da, the wheel gear 13 collides with the first thrust collar 50A or the second thrust collar 50B. For this reason, regardless of a movement direction of the pinion gear 23 and the driven shaft 21, the movement of the pinion gear 23 and the driven shaft 21 in the axial direction Da can be restricted.

(11) According to the centrifugal compressors 10A to 10E of an eleventh aspect, in the centrifugal compressors 10A to 10E described in (10), an interval S between the first thrust collar 50A and the second thrust collar 50B in the axial direction Da is larger than a thickness T of the wheel gear 13 in the axial direction Da.

Accordingly, when the centrifugal compressors 10A to 10E are assembled, the first thrust collar 50A and the second thrust collar 50B are less likely to interfere with the pinion gear 23 or the wheel gear 13. Accordingly, the pinion gear 23 and the wheel gear 13 can easily mesh with each other, and workability when the centrifugal compressor 10A is assembled can be improved.

According to the centrifugal compressor of the present disclosure, it is possible to suppress a misalignment of the thrust collar, which has received a reaction force form the wheel gear, with respect to the driven shaft in the axial direction while fixing the thrust collar to the driven shaft without using shrink fitting.

EXPLANATION OF REFERENCES

10A to 10E: Centrifugal compressor
11: Casing
12: Drive shaft
13: Wheel gear
13*g*: Wheel gear teeth
18: Intake flow path
19: Exhaust flow path
20: Speed increase and transmission unit
21, 21C: Driven shaft
22: Radial bearing
23, 23E: Pinion gear
231, 231D: Gear base portion
231*f*, 231*g*: Base portion end surface
232: Tooth portion
232*f*: Tooth portion end surface
232*g*: Gear teeth
239: Through-hole
241: Disk
241*a*: First surface
241*b*: Second surface
242: Blade
243: Cover
245: Impeller flow path
245*i*: Inlet
245*o*: Outlet
25: Impeller
25A: First impeller
25B: Second impeller
29: Recessed portion
30A, 30B: Centrifugal compression unit
50D, 50E: Thrust collar
50A: First thrust collar
50B: Second thrust collar
501: Main collar portion
502: Protruding portion
51: First portion
52: Second portion
53, 53D: Bolt insertion hole
54, 54D: Shaft insertion portion
55D: Head accommodating portion
56: Stepped surface
58: Inner peripheral surface
60: Screw hole
60*b*: Bottom portion
61: Tubular portion
62: Female screw groove portion
62*m*: Female screw
621: Female screw portion

622: Bottom portion-side incomplete female screw portion
623: Incomplete female screw portion
70: Bolt
71: Shaft portion
71*b*: Proximal end portion
71*s*: Distal end portion
72: Head portion
72*f*: Seating surface
73: Columnar portion
74: Male screw shaft portion
74*m*: Male screw
741: Male screw portion
742: Distal end-side incomplete male screw portion
743: Incomplete male screw portion
78: Nut
90: Boss
91, 96: Abutting surface
95: Projection portion
C1: First central axis
C2: Second central axis
D1: Depth
Da: Axial direction
Da1: First side
Da2: Second side
Dc1: First circumferential direction
Dc2: Second circumferential direction (circumferential direction)
Dr1: First radial direction
Dri1: Inner side
Dri2: Inner side
Dr2: Second radial direction (radial direction)
Dro1: Outer side
Dro2: Outer side
T: Thickness

What is claimed is:

1. A centrifugal compressor comprising:

a drive shaft extending along a first central axis and rotatable around the first central axis;

a wheel gear rotating around the first central axis, together with the drive shaft;

a driven shaft disposed parallel to the drive shaft, extending in an axial direction in which the first central axis extends, and rotatable around a second central axis;

a pinion gear disposed to be rotatable around the second central axis, together with the driven shaft, and meshing with the wheel gear;

an impeller that is disposed at a different position in the axial direction with respect to the pinion gear, and that configured to compress a working fluid by rotating around the second central axis, together with the driven shaft;

a thrust collar disposed adjacent to the pinion gear in the axial direction, and restricting a displacement of the driven shaft in the axial direction by colliding with the wheel gear in the axial direction on an outer side in a radial direction, which around the second central axis, with respect to the driven shaft; and a plurality of bolts disposed at intervals in a circumferential direction, which around the second central axis, each extending in the axial direction, and fixing the thrust collar and the pinion gear, wherein each of the plurality of bolts fix the thrust collar and the pinion gear in a state where each of the plurality of bolts is inserted from a position opposite to the wheel gear with reference to the thrust collar in the axial direction.

2. The centrifugal compressor according to claim 1, wherein the thrust collar is formed such that a first portion located on an inner side in the radial direction is allowed to come into contact with the pinion gear in the axial direction and a second portion located on the outer side in the radial direction with respect to the first portion is allowed to come into contact with the wheel gear in the axial direction.

3. The centrifugal compressor according to claim 2, wherein the pinion gear includes a gear base portion formed on the outer side in the radial direction with respect to the driven shaft and extending in the circumferential direction, and a tooth portion protruding to the outer side in the radial direction with respect to the gear base portion and including a plurality of gear teeth formed at intervals in the circumferential direction, and the first portion is fixed to the gear base portion by the plurality of bolts.

4. The centrifugal compressor according to claim 3, wherein the pinion gear includes a plurality of screw holes formed in the gear base portion at intervals in the circumferential direction, each of the plurality of screw holes is recessed to extend from a base portion end surface of the gear base portion in the axial direction, the base portion end surface facing the axial direction, each of the plurality of screw holes includes a female screw portion and an incomplete female screw portion on an inner peripheral surface, the incomplete female screw portion being formed at a position close to the base portion end surface with respect to the female screw portion in the axial direction, each of the plurality of bolts includes a shaft portion extending in the axial direction and including a male screw portion on an outer peripheral surface, the male screw portion meshing with the female screw portion, and a head portion formed on an end portion of the shaft portion and formed to expand toward the outer side in the radial direction with respect to the shaft portion, and the shaft portion includes an incomplete male screw portion disposed at a position close to the head portion with respect to the male screw portion in the axial direction and at an interval from the incomplete female screw portion in the axial direction.

5. The centrifugal compressor according to claim 4, wherein the tooth portion has a tooth portion end surface facing the same side as the base portion end surface in the axial direction, and the male screw portion and the female screw portion are disposed at a position overlapping the tooth portion end surface in the axial direction.

6. The centrifugal compressor according to claim 4, wherein the thrust collar has a plurality of bolt insertion holes into which the plurality of bolts are each inserted, and each of the plurality of bolt insertion holes includes a shaft insertion portion into which the shaft portion is inserted, and a head accommodating portion formed on a side opposite to the pinion gear with respect to the shaft insertion portion in the axial direction, and accommodating the head portion.

7. The centrifugal compressor according to claim 6, wherein the thrust collar includes a main collar portion in which the shaft insertion portion is formed, and a protruding portion formed with a smaller diameter than a diameter of the main collar portion when viewed in the axial direction, and protruding from the main collar portion in the axial direction, and the head accommodating portion is formed in the protruding portion.

8. The centrifugal compressor according to claim 1, wherein the pinion gear includes a recessed portion recessed from an outer peripheral surface of the pinion gear to an inner side in the radial direction, and the thrust collar is fixed to the pinion gear by the plurality of bolts and nuts accommodated in the recessed portion to be fitted to the plurality of bolts.

9. The centrifugal compressor according to claim 1, wherein the thrust collar is formed in an annular shape extending in the circumferential direction, and the pinion gear or the driven shaft has an abutting surface facing the outer side in the radial direction and abutting against an inner peripheral surface of the thrust collar.

10. The centrifugal compressor according to claim 1, wherein the impeller includes a first impeller disposed on a first side in the axial direction with respect to the pinion gear, and a second impeller disposed on a second side in the axial direction with respect to the pinion gear, and the thrust collar includes a first thrust collar disposed on the first side in the axial direction with respect to the pinion gear, and a second thrust collar disposed on the second side in the axial direction with respect to the pinion gear.

11. The centrifugal compressor according to claim 10, wherein an interval between the first thrust collar and the second thrust collar in the axial direction is larger than a thickness of the wheel gear in the axial direction.

* * * * *